US012036445B2

(12) United States Patent
Deblandre et al.

(10) Patent No.: US 12,036,445 B2
(45) Date of Patent: Jul. 16, 2024

(54) GOLF BALLS

(71) Applicant: SOLCHEM GMBH, Aachen (DE)

(72) Inventors: Alain Deblandre, Lontzen (BE); Josephine Deblandre, Lontzen (BE)

(73) Assignee: SOLCHEM GMBH, Aachen (DE)

( * ) Notice: Subject to any disclaimer, the term of this patent is extended or adjusted under 35 U.S.C. 154(b) by 52 days.

(21) Appl. No.: 17/788,827

(22) PCT Filed: Dec. 24, 2020

(86) PCT No.: PCT/EP2020/087867
§ 371 (c)(1),
(2) Date: Jun. 24, 2022

(87) PCT Pub. No.: WO2021/130365
PCT Pub. Date: Jul. 1, 2021

(65) Prior Publication Data

US 2023/0035160 A1 Feb. 2, 2023

(30) Foreign Application Priority Data

Dec. 26, 2019 (GB) ..... 1919332

(51) Int. Cl.
*A63B 37/06* (2006.01)
*A63B 37/00* (2006.01)
*A63B 43/06* (2006.01)

(52) U.S. Cl.
CPC ..... *A63B 37/00221* (2020.08); *A63B 43/06* (2013.01)

(58) Field of Classification Search
CPC ..... A63B 45/00; A63B 37/0024
See application file for complete search history.

(56) References Cited

U.S. PATENT DOCUMENTS

| | | | | |
|---|---|---|---|---|
| 2,861,810 | A * | 11/1958 | Veatch | A63B 24/0021 D21/709 |
| 6,554,723 | B1 | 4/2003 | Ryuhe | |
| 7,278,931 | B2 | 10/2007 | Toshihiko | |
| 7,479,072 | B2 | 1/2009 | Satoko | |
| 7,731,608 | B2 | 6/2010 | Kennedy | |
| 8,641,558 | B2 | 2/2014 | Takashi | |
| 9,409,064 | B2 | 8/2016 | Fitchett | |
| 9,433,826 | B1 * | 9/2016 | Comeau | A63B 37/14 |
| 10,208,425 | B2 | 2/2019 | Tutmark | |
| 2006/0286357 | A1 | 12/2006 | Satoko | |
| 2010/0222159 | A1 | 9/2010 | Satoko | |
| 2013/0304417 | A1 | 11/2013 | Mooney | |
| 2013/0324310 | A1 | 12/2013 | Leech | |
| 2014/0018187 | A1 | 1/2014 | Lin | |

FOREIGN PATENT DOCUMENTS

| | | | |
|---|---|---|---|
| CA | 2360377 | | 8/2000 |
| CN | 201997065 | | 10/2011 |
| GB | 2360221 | | 9/2001 |
| JP | 4159200 | | 4/2001 |
| JP | 2008161375 | | 7/2008 |
| JP | 3156480 | U | 12/2009 |
| JP | 2018009212 | | 1/2018 |
| KR | 200167658 | U | 2/2000 |
| KR | 200401143 | U | 11/2005 |
| KR | 200440842 | U | 2/2008 |
| KR | 100941494 | | 7/2009 |
| KR | 20130094273 | | 8/2013 |
| KR | 20150066747 | | 6/2015 |
| KR | 20160041373 | | 4/2016 |
| WO | 20121691789 | | 12/2012 |

OTHER PUBLICATIONS

ISR for PCT/EP2020/087867.
Written Opinion for PCT/EP2020/087867.
PR on Patentability for PCT/EP2020/087867.

* cited by examiner

*Primary Examiner* — Raeann Gorden
(74) *Attorney, Agent, or Firm* — SCHNEIDER IP LAW; Jerold I. Schneider

(57) ABSTRACT

A reflective golf ball comprises a layer of silver having an average thickness ≥0.05 μm and ≤0.5 μm, notably deposited by reduction of a silvering solution, and a translucent, protective layer provided over the layer of silver.

22 Claims, No Drawings

GOLF BALLS

This invention relates to golf balls and their manufacture, and more particularly to a golf ball provided with a reflective coating.

Golf balls generally comprise a spherical, elastomeric core surrounded by one or more cover layers and optionally an exterior coating. The core is generally moulded from rubber or synthetic rubber, for example polybutadiene. The exterior surface of the one of more cover layers is provided with dimples and is generally printed to indicate, for example, the manufacturer, type of golf ball and player number. The exterior coating, generally a transparent, thin, glossy layer is often sprayed on to the exterior face of the one or more cover layers; a clear resin layer which is cured subsequent to spraying is often used. In a two-piece golf ball, a single cover layer, for example of surlyn or urethane is mounded around the core, for example by injection moulding. In a three-piece golf ball, the cover layers comprise an interior cover layer for example of enhanced rubber and exterior cover layer for example of surlyn, balata or urethane. In a four-piece golf ball the cover layers comprise an inner cover layer, a middle cover layer and an outer cover layer.

Whilst most golf balls are white, golf ball which are yellow, pink, orange or other colours are also available. Such colours are intended to make the golf ball easier to spot or make it easier to distinguish each player's golf ball. Gloss or matt finishes are available. The colour may be provided by incorporating a desired colour into the material of the exterior cover layer or by applying a coloured layer, for example a sprayed paint, over the exterior surface of the cover layer(s), generally prior to applying a transparent exterior coating. It would be advantageous, particularly to enhance the visibility of a golf ball during flight and on the ground, to give the golf ball a reflective, metallic appearance. Previous proposals for providing a reflective, metallic appearance to a golf ball include:

- U.S. Pat. No. 7,278,931 which discloses a golf ball having an outermost resin cover layer which contains glass flakes coated with a metal (eg gold, silver, nickel) or metal oxide (eg titanium dioxide);
- US2009/0291776 A1 which discloses a golf ball which has a core, a conductive paint layer coated on the surface of the core, a reflective layer formed by electroplating a bright thin surface metal layer on the conductive paint layer and a transparent layer formed on the reflective layer;
- JP3156480U which discloses a golf ball provided with a light reflective layer provided over its core and beneath a colourless, transparent resin cover layer having dimples in its outer surface, the light reflective layer being a coated film layer containing aluminium pigment or a film formed by vapour deposition of aluminium;
- US20130324310 which discloses a reflective material, for example retro-reflective crystals, reflective metal, a conductive polymer or a reflective coating, incorporated in or applied to a golf ball's exterior coating so that the reflection system is exposed over no more than 4.5% of the exterior surface of the golf ball;
- KR20130094273 A which discloses a golf ball whose surface is coated with metal particles by a silver mirror coating prior to covering with a translucent urethane paint which can be coloured;
- KR20150066747A which discloses hammering a gold foil, silver foil, copper foil or aluminium foil over the outer surface of a golf ball using a fabric hammer to provide a please appearance for a gift or decoration;
- U.S. Pat. No. 2,861,810 which discloses a golf ball having in its outer surface a plurality of depressions which are coated with a mirror-like metallic film not over about 0.0001 inch thick and discloses aluminium, platinum, tungsten, tantalum, molybdenum, nickel, chromium, silver, copper, gold and alloys thereof as examples metals which can be used; and
- US2016/0279480 A1 which discloses a metallic film that is formed about the outer surface of a golf ball by contacting a catalytic coating with a mixture comprising: (i) at least one aqueous and/or organic aerosol comprising at least one metal in cationic/oxidizing form; and (ii) at least one reducing agent, the metal being selected from the group consisting of: silver, gold, copper, nickel, zinc, cobalt, tin, boron, tungsten, and combinations thereof.

Despite many such proposals, golf balls having a reflective, metallic appearance have not found commercial success. One aim of the present invention is to provide an advantageous way of providing golf balls with a reflective, metallic appearance in a way which will permit widespread commercialisation.

In accordance with one of its aspects, the present invention provides a method of manufacturing a golf ball in accordance with claim 1. Other aspects are defined in other independent claims. The dependent claims define preferred or alternative features.

The present golf balls preferably have a construction of the type described above; they may be two-piece, three-piece or four-piece golf balls.

The golf balls are intended for use playing golf as opposed to being used for decoration or as ornaments. Thus, the golf balls preferably meet the specifications for golf balls of the United States Golf Association and/or the Royal and Ancient Golf Club of St Andrews, Scotland, as in force on 1 Jan. 2020, the said specifications being incorporated herein by reference. Notably, the golf balls preferably have the following features:

a weight ≤1.620 ounces (45.93 g); and a diameter ≥1.680 inches (42.67 mm).

Whilst not wishing to be bound by theory, it is believed that the deposition of the silver layer having an average thickness ≥0.05 μm and ≤0.5 μm at the deposition surface, notably by mixing the silvering solution and the reducing solution results in a silver layer which is more resistant to damage when the golf ball is used than other types of reflective layers. The silver layer would be expected to undergo impact and deformation when the golf ball is struck with a golf club and this ability to resist damage, for example cracking or flaking, in such circumstances thus improves the ability to provide a consistent quality for a golf ball, notably in a way that is compatible with standard manufacturing techniques. The use of a relatively small quantity of silver also avoids unnecessary use of resources. An average thickness of the layer of silver which is ≥0.05 μm and ≤0.5 μm, preferably ≥0.06 μm or more preferably ≥0.07 μm is advantageous for providing a suitable level of luminous reflectance. The average thickness of the silver layer is advantageously ≤0.20 μm, preferably ≤0.15 and more preferably ≤0.12 μm and even more preferably ≤0.10 μm; it is believed that greater thicknesses do not significantly improve the performance or appearance of the silver layer. A particularly preferred average thickness of the silver layer is ≥0.07 μm and ≥0.12 μm. As used herein, the term "average thickness of the silver layer" means the thickness that the silver layer would have if all of the silver which makes up the silver layer was present at the deposition surface in a constant thickness. Preferably, the variation of actual thickness of the silver layer is less than ±10% of the average thickness, more preferably less than ±5% of the average thickness.

The silver layer is preferably deposited by combining a silvering solution comprising silver ions in solution and a reducing solution which, when combined with the silvering solution, provokes precipitation of the silver ions. Generally, this type of silver deposition relies upon the combining and/or mixing of i) a silver salt, preferably silver nitrate, in solution, for example ammoniacal silver nitrate, provided by the silvering solution and ii) the combination of a reducing agent, preferably a sugar, and a base, preferably sodium hydroxide, notably ammoniacal sodium hydroxide, provided by the reducing solution. The silvering solution and/or the reducing solution may contain one or more additives notably selected from wetting agents and non-sludging agents. The inclusion of a non-sludging agent in the reducing solution is particularly preferred; this facilitates formation of a highly reflective surface of the layer of silver. The silver solution is preferably an ammoniacal silver nitrate solution, notably having a concentration of silver nitrate in the range 200 to 300 g $AgNO_3$ per litre and an ammonia concentration of 90 to 140 g of ammonia per litre.

The silvering solution and the reducing solution may be sprayed, simultaneously or sequentially, towards the deposition surface from respective spray nozzles in order to deposit the silver layer at the deposition surface. Alternatively, deposition of the silver layer may comprise dipping the deposition surface in the silvering solution and subsequent spraying of the reducing solution towards the deposition surface.

Prior to depositing the silver layer, the deposition surface is preferably activated and/or sensitized. The deposition surface is preferably activated and sensitized prior to deposition of the silver layer, the activating preferably being carried out prior to the sensitizing. A preferred order is: activating; rinsing with deionized water; sensitizing; rinsing with deionized water; deposition of the silver layer. Preferably, activating the deposition surface comprises spraying the deposition surface with an activating solution; nevertheless, activating by dipping of the deposition surface in the activating solution is also possible. Likewise, sensitizing the deposition surface preferably comprises spraying the deposition surface with a sensitizing solution but sensitizing by dipping of the deposition surface in the sensitizing solution is also possible. Rinsing with deionized water is preferably carried out by spraying.

The activating solution preferably comprises a carbon-based activator. As used herein, the term "carbon-based activator" means a molecule or compound which is based on carbon as opposed to being, for example, a silane or other molecule or compound based on silicon. A preferred activator is tannic acid; other molecules or compound which are derivatives of tannic acid or similar in structure may be used as the activator. The activating solution may comprise ≥5 g/l and/or ≤100 g/l of activator, particularly when this is tannic acid; 30 g/l of tannic acid provides a particularly advantageous activating solution for the methods described herein. Preferably, the activated deposition surface is rinsed with deionized water subsequent to activating, notably prior to any sensitizing and prior to deposition of the silver layer.

The sensitizing solution preferably comprises tin (II) ions in aqueous solution, notably tin dichloride in aqueous solution, preferably a stabilised aqueous solution. A concentration in the range 3 to 12 g tin dichloride per litre provides a suitable sensitizing solution. Preferably, the sensitized deposition surface is rinsed with deionized water subsequent to sensitizing and prior to deposition of the silver layer.

The translucent, protective layer may be provided by an exterior coating deposited over the silver layer, notably by spraying. This is particularly advantageous for a two-layer golf ball as in this case the silver layer may be deposited over the cover layer and subsequently overlaid with the exterior coating. This facilitates incorporation of the silver layer in the manufacturing process. Alternatively, the translucent, protective layer may be provided by a cover layer; this is particularly advantageous for a three-layer or four-layer golf ball as the silver layer may be deposited on one of the cover layers and subsequently overlaid by another cover layer. This provides increased protection for the layer of silver. The translucent, protective layer may be transparent; that is to say that it imparts substantially no additional colour to the reflective silver layer when viewed through the protective layer. Alternatively, the translucent, protective layer may be coloured so that it imparts an additional colour to the reflective silver layer when viewed through the protective layer.

The deposited silver layer may be treated with a coupling agent prior to deposition of its overlying protective layer. The coupling agent may facilitate adhesion between the layer of silver and its overlying layer; it may be selected from silanes, aluminates, titanites; zirconates and mixtures thereof. The coupling agent is preferably applied by spraying but dip coating is also possible.

The reflective surface of the silver layer preferably has a luminous reflectance ≥92.0%, more preferably ≥93.5% and even more preferably ≥94.0%; this provides a suitable level of reflection. The luminous reflectance of the silver layer is preferably ≥97.0%; this provides good reflectivity without requiring excessively complex deposition techniques or reflective structures. Unless otherwise specified, the luminous reflectance referred to herein is measured at 540 μnm. The golf balls generally have a luminous reflectance which is less than that of the reflective surface of the silver layer; this is generally due to absorption of one or more layers overlying the silver layer. Preferably, the golf balls have a luminous reflectance which is ≥88.0%, ≥89.0, ≥90.0% or ≥92.0% and/or ≤96.0% or ≤95.0%. A luminous reflectance which is ≥90.0% and ≤96.0% provides particularly good visibility for the golf ball, notably where the translucent protective layer is transparent. Particularly where the translucent protective layer is coloured, the luminous reflectance of the golf balls may be lower.

Arranging for the silver layer to overlay at least 80% and preferably at least 90% of the surface area of the deposition surface further contributes to good visibility of the golf ball.

By way of non-limiting example, an exposed deposition surface of a golf ball was:

i) activated by being dipped in a dilute solution of tannic acid (concentration 30 g/l of tannic acid);
ii) subsequently rinsed by being sprayed with deionized water;
iii) subsequently activated by being sprayed with a freshly prepared and stabilized aqueous solution of tin dichloride (concentration 7 g/l of tin dichloride); iv) subsequently rinsed by being sprayed with deionized water; and
v) subsequently sprayed simultaneously with a silvering solution and a reducing solution to deposit a layer of silver at the deposition surface.

Once dry, the luminous reflectance of the reflective surface of the silver layer was measured. The silver layer was subsequently dissolved and the quantity of dissolved silver was determined by titration. From this, the weight of silver (in g/m$^2$) and the average thickness of the layer of silver was deduced on the basis of the surface area of the deposition surface and the assumption of a constant thickness of the silver layer. The results are shown in Table 1.

TABLE 1

| Luminous reflectance of silver layer at 540 nm | Weight of silver layer | Thickness of silver layer |
|---|---|---|
| 95.5% | 915.3 g/m$^2$ | 0.087 μm |

The layer of silver of the golf ball could be covered with an overlying, protective translucent clear or coloured coating to provide a reflective golf ball for use.

A damage resistance test was carried out in the following way for silver layers having different thicknesses but which were otherwise the same:

i) a clean glass test substrate was prepared by sequentially activating with a 30 g/l tannic acid aqueous solution, rinsing with distilled water, sensitizing with a 10 g/l tin dichloride aqueous solution and rinsing with distilled water;

ii) a silver layer was subsequently deposited on the prepared surface of the substrate by spaying an aqueous silver nitrate solution and an aqueous reducing solution;

iii) the silver layer was then dried using warm air and subjected to the damage resistance test.

The damage resistance test consisted of manually but firmly pressing an adhesive tape against the exposed surface of the silver layer, subsequently pulling the tape away from the silver layer and then examining the silver layer and the tape. The tape was contacted with and pulled away from each silver layer in the same way. The results are shown in Table 2.

TABLE 2

| Weight and thickness of silver layer | Observations from damage resistance test on silver layer |
|---|---|
| 725 mg/m$^2$<br>0.07054 μm | No visible silver residue on tape; surface of silver layer slightly disturbed; no other visible damage to silver layer |
| 1060 mg/m$^2$<br>0.10105 μm | Silver residue present on tape (bright silver particles); surface of silver layer heavily disturbed; visible damage to silver layer |

The invention claimed is:

1. A method of manufacturing a golf ball, the golf ball comprising a core and at least one cover layer surrounding the core, the method comprising:

a) depositing a layer of silver having an average thickness which is ≥0.05 μm and ≤0.5 μm at a deposition surface of the golf ball to provide a reflective silver layer; and b) covering the reflective silver layer with a translucent, protective layer;

wherein the silver layer overlays at least 80% of the surface area of the deposition surface;

wherein prior to depositing the silver layer, the deposition surface is activated and sensitized;

wherein depositing the layer of silver comprises depositing the layer of silver at the deposition surface from an aqueous silvering solution by combining a silvering solution comprising silver ions in solution and a reducing solution which, when combined with the silvering solution, provokes precipitation of the silver ions; and wherein prior to depositing the silver layer, the deposition surface is sequentially activated with an activating agent comprising tannic acid in aqueous solution, rinsed with deionised water, sensitized and again rinsed with deionised water.

2. The method of claim 1, wherein deposition of the layer of silver comprises simultaneously or sequentially spraying the silvering solution and the reducing solution towards the deposition surface from respective spray nozzles.

3. The method of claim 1, wherein deposition of the layer of silver comprises depositing the layer of silver by dipping the deposition surface in the silvering solution and subsequently spraying the reducing solution towards the deposition surface.

4. The method of claim 1, wherein the deposition surface is a surface of the at least one cover layer.

5. The method of claim 1, wherein the translucent, protective layer is selected from:

a) a translucent, protective layer which comprises a cover layer deposited over the silver layer;

b) a translucent, protective layer which comprises a cover layer deposited over the silver layer by moulding;

c) a translucent, protective layer which comprises an exterior coating deposited over the silver layer; and d) a translucent, protective layer which comprises an exterior coating deposited over the silver layer by spraying.

6. The method of claim 1, wherein the reflective silver layer has luminous reflectance at 540 nm which is ≥92.0% and ≤97.0%.

7. The method of claim 1, wherein the golf ball has a luminous reflectance at 540 nm which is ≥90.0% and ≤96.0%.

8. The method of claim 1, wherein the silver layer overlays at least 90% of the surface area of the deposition surface.

9. The method of claim 1, wherein the deposition surface of the golf ball is a dimpled surface of a cover layer of the golf ball.

10. The method of claim 1, wherein the depositing of the layer of silver comprises depositing a silver layer having an average thickness which is ≥0.05 μm and ≤0.12 μm.

11. A method of manufacturing a golf ball, the golf ball comprising a core and at least one cover layer surrounding the core, the method comprising:

a) depositing a layer of silver having an average thickness which is ≥0.05 μm and ≤0.5 μm at a deposition surface of the golf ball to provide a reflective silver layer; and b) covering the reflective silver layer with a translucent, protective layer;

wherein the silver layer overlays at least 80% of the surface area of the deposition surface;

wherein prior to depositing the silver layer, the deposition surface is activated and sensitized; and wherein depositing the layer of silver comprises depositing the layer of silver at the deposition surface from an aqueous silvering solution by combining a silvering solution comprising silver ions in solution and a reducing solution which, when combined with the silvering solution, provokes precipitation of the silver ions; and wherein prior to depositing the silver layer, the deposition surface is sequentially activated, rinsed with deionised water, sensitized with a sensitizing agent comprising tin (II) ions in aqueous solution and again rinsed with deionised water.

12. The method of claim 11, wherein the sensitizing agent comprising tin dichloride in a stabilized aqueous solution.

13. The method of claim 11, wherein deposition of the layer of silver comprises simultaneously or sequentially spraying the silvering solution and the reducing solution towards the deposition surface from respective spray nozzles.

14. The method of claim 11, wherein deposition of the layer of silver comprises depositing the layer of silver by dipping the deposition surface in the silvering solution and subsequently spraying the reducing solution towards the deposition surface.

15. The method of claim 11, wherein the deposition surface is a surface of the at least one cover layer.

16. The method of claim 11, wherein the translucent, protective layer is selected from:

a) a translucent, protective layer which comprises a cover layer deposited over the silver layer;

b) a translucent, protective layer which comprises a cover layer deposited over the silver layer by moulding;

c) a translucent, protective layer which comprises an exterior coating deposited over the silver layer; and d) a translucent, protective layer which comprises an exterior coating deposited over the silver layer by spraying.

17. The method of claim 11, wherein the reflective silver layer has luminous reflectance at 540 nm which is ≥92.0% and ≤97.0%.

18. The method of claim 11, wherein the golf ball has a luminous reflectance at 540 nm which is ≥90.0% and ≤96.0%.

19. The method of claim 11, wherein the silver layer overlays at least 90% of the surface area of the deposition surface.

20. The method of claim 11, wherein the deposition surface of the golf ball is a dimpled surface of a cover layer of the golf ball.

21. The method of claim 11, wherein the depositing of the layer of silver comprises depositing a silver layer having an average thickness which is ≥0.05 μm and ≤0.12 μm.

22. A method of manufacturing a golf ball, the golf ball comprising a core and at least one cover layer surrounding the core, the method comprising:

a) depositing a layer of silver having an average thickness which is ≥0.05 μm and ≤0.12 μm at a deposition surface of the golf ball to provide a reflective silver layer; and b) covering the reflective silver layer with a translucent, protective layer;

wherein prior to depositing the silver layer, the deposition surface is sequentially activated, rinsed with deionised water, sensitized with a sensitizing agent comprising tin (II) ions in aqueous solution and again rinsed with deionised water; and wherein depositing the layer of silver comprises depositing the layer of silver at the deposition surface from an aqueous silvering solution by combining a silvering solution comprising silver ions in solution and a reducing solution which, when combined with the silvering solution, provokes precipitation of the silver ions and in which deposition of the layer of silver comprises simultaneously or sequentially spraying the silvering solution and the reducing solution towards the deposition surface from respective spray nozzles;

such that the silver layer of the golf ball overlays at least 80% of the surface area of the deposition surface and has luminous reflectance at 540 nm which is ≥92.0% and ≤97.0%.

* * * * *